US010808460B2

(12) United States Patent
Weston

(10) Patent No.: US 10,808,460 B2
(45) Date of Patent: Oct. 20, 2020

(54) TELESCOPIC LADDER WITH RETRACTABLE STABILISER BARS

(71) Applicant: TELETOWER.COM LIMITED, Woodford Green, Essex (GB)

(72) Inventor: Richard Weston, Halstead (GB)

(73) Assignee: TELETOWER.COM LIMITED, Woodford Green, Essex (GB)

( * ) Notice: Subject to any disclaimer, the term of this patent is extended or adjusted under 35 U.S.C. 154(b) by 133 days.

(21) Appl. No.: 16/308,458

(22) PCT Filed: Jun. 6, 2017

(86) PCT No.: PCT/IB2017/053327
§ 371 (c)(1),
(2) Date: Dec. 8, 2018

(87) PCT Pub. No.: WO2017/212401
PCT Pub. Date: Dec. 14, 2017

(65) Prior Publication Data

US 2019/0271192 A1 Sep. 5, 2019

(30) Foreign Application Priority Data

Jun. 9, 2016 (GB) ..... 1610109.9

(51) Int. Cl.
*E06C 7/42* (2006.01)
*E06C 1/12* (2006.01)

(52) U.S. Cl.
CPC ..... *E06C 7/423* (2013.01); *E06C 1/125* (2013.01); *E06C 7/42* (2013.01)

(58) Field of Classification Search
CPC ..... E06C 7/423; E06C 1/125
See application file for complete search history.

(56) References Cited

U.S. PATENT DOCUMENTS

| | | | | |
|---|---|---|---|---|
| 9,347,263 | B2 * | 5/2016 | Weston | E06C 1/125 |
| 9,416,591 | B2 * | 8/2016 | Kieffer | E06C 1/125 |
| 2016/0153232 | A1 * | 6/2016 | Kieffer | E06C 1/125 182/104 |

FOREIGN PATENT DOCUMENTS

| | | | | |
|---|---|---|---|---|
| FR | 3012511 | A1 * | 5/2015 | E06C 7/46 |
| GB | 2529731 | A * | 3/2016 | E06C 7/423 |

* cited by examiner

*Primary Examiner* — Alvin C Chin-Shue
(74) *Attorney, Agent, or Firm* — Adenike Adebiyi

(57) ABSTRACT

A collapsible ladder (10) is disclosed having rungs secured to telescopically collapsible stile sections and at least one stabiliser bar secured to the foot of the ladder, the (or each) stabiliser bar (12*a*, 12*b*) being displaceable between a storage position in which the bar lies, at least predominantly, between the two stiles and a deployed position in which the bar widens the footprint of the ladder to improve the lateral stability of the ladder. A rod (20) is connected to extend downwardly from the uppermost stile section of the ladder and a catch mechanism (30) is provided at the foot of the ladder to engage the lower end of the rod to prevent the ladder from being extended. The catch mechanism (30) is operable by the (or a) stabiliser bar to release the rod and permit the ladder to be extended only when the stabiliser bar is in the deployed position.

11 Claims, 2 Drawing Sheets

TELESCOPIC LADDER WITH RETRACTABLE STABILISER BARS

FIELD

The invention relates to a collapsible ladder.

BACKGROUND

Ladders are known that can be collapsed telescopically for ease of storage and transportation, one example being described in U.S. Pat. No. 5,495,915. The ladder has two stiles that are made up of telescopically collapsible sections. Each rung is secured to the upper end of a section in one stile and to the upper end of a corresponding section in the other stile. To prevent the ladder from collapsing when extended, latches are fitted to the underside of the rungs. The latches have spring biased pins that engage in holes in the stile sections, the holes being aligned when the ladder is extended. Because of the spring bias, the latches engage in the holes automatically when the ladder is extended. To collapse the ladder in the case of some ladders that are currently commercially available, the latches are disengaged manually one ladder section at a time. In the case of the ladder described in U.S. Pat. No. 5,495,915, once the latches of the lowermost stile section have been released manually, the remaining stile sections are released automatically one at a time, the collapse of each section serving to permit collapse of the section immediately above it.

It is also known to fit ladders, both of the telescopic and other varieties, with stabiliser bars. These bars project laterally from the foot of the ladder to widen its footprint and thereby reduce the risk of the ladder toppling sideways. Retractable stabiliser bars have been proposed that can be moved to a storage position in which they are located between the two stiles instead of projecting laterally beyond the stiles.

A problem that is encountered during use of ladders fitted with retractable stabiliser bars is that through laziness, or forgetfulness, the stabiliser bars are not deployed by the user.

SUMMARY

With a view to mitigating this problem the present invention provides a collapsible ladder having rungs secured to telescopically collapsible stile sections and at least one stabiliser bar secured to the foot of the ladder, the (or each) stabiliser bar being displaceable between a storage position in which the bar lies, at least predominantly, between the two stiles and a deployed position in which the bar widens the footprint of the ladder to improve the lateral stability of the ladder, wherein an inextensible member connected to the uppermost ladder section is secured to the foot of the ladder by a catch mechanism when the ladder is collapsed, the catch mechanism being operable by the (or a) stabiliser bar to permit the ladder to be extended only when the stabiliser bar is in the deployed position.

In an embodiment of the invention the inextensible member is a rod connected to extend downwardly from the uppermost stile section of the ladder.

The invention mitigates the problem of the user not deploying the stabiliser bars by preventing a telescopic ladder from being extended until such time as the stabiliser bars have been deployed.

Of course, once the ladder has been extended, it is conceivable that the user may intentionally or accidentally retract the stabiliser bars while the ladder remains in its extended position.

To safeguard against such eventuality, in an embodiment of the invention a resiliently biased detent is provided to prevent movement of the stabiliser bar away from the deployed position, and the detent is movable by the rod connected to the uppermost stile section of the ladder to allow the stabiliser bar to be retracted only when the ladder is fully telescopically collapsed.

By thus ensuring that the ladder cannot be extended unless the stabiliser bars have been deployed and preventing retraction of the stabiliser bars until the ladder is fully collapsed, the latter embodiment of the invention ensures that the ladder can only ever be used with the stabiliser bars deployed.

BRIEF DESCRIPTION OF THE DRAWINGS

The invention will now be described further, by way of example, with reference to the accompanying drawings, in which.

DETAILED DESCRIPTION OF THE DRAWINGS

Figure 1:
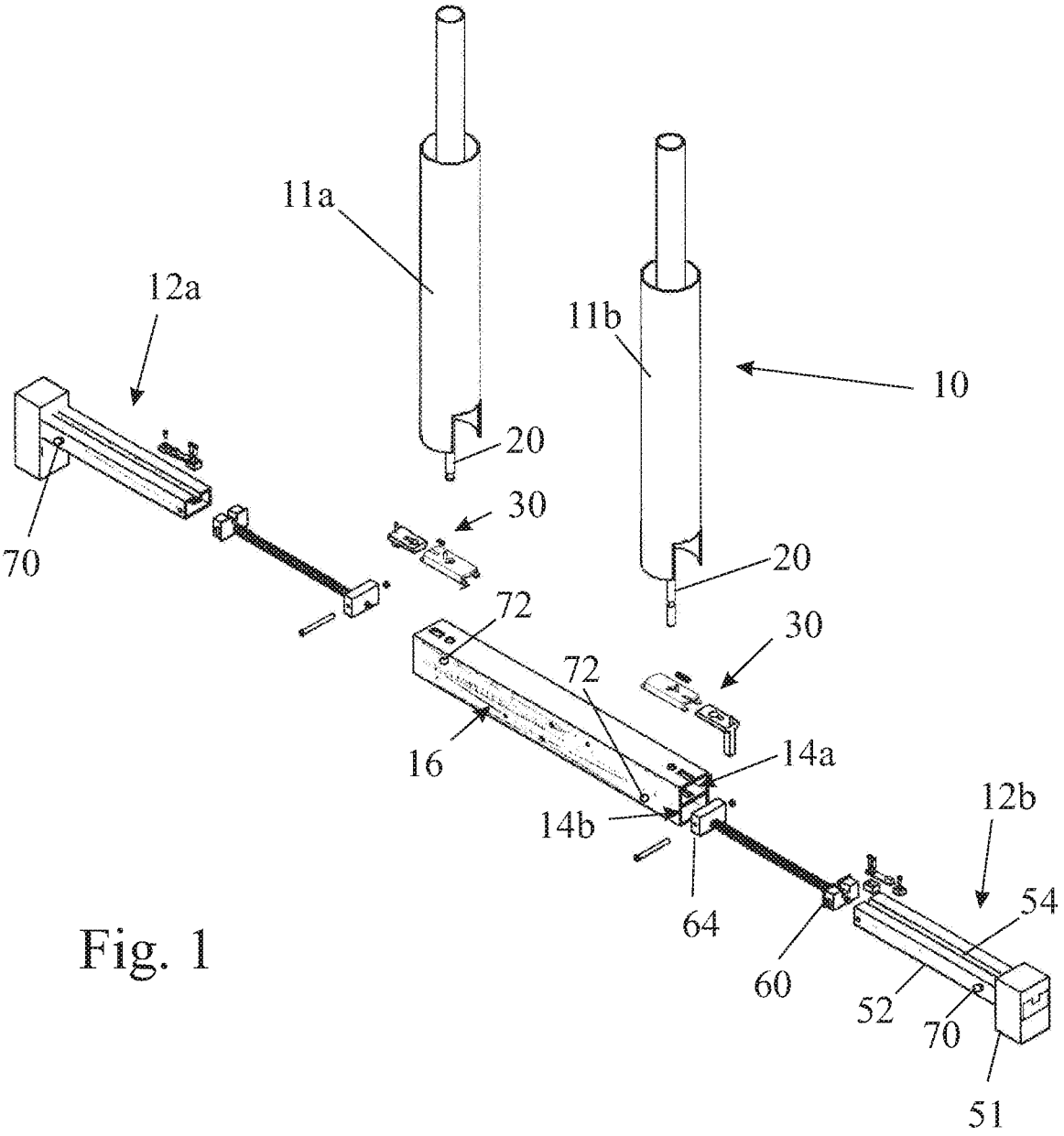
FIG. 1 is a partial exploded view showing the foot of a telescopically collapsible ladder fitted with retractable stabiliser bars.

FIG. 1 shows is an exploded diagram of the foot of a telescopically collapsible ladder 10 fitted with stabiliser bars 12*a* and 12*b* that are retractable into two chambers 14*a* and 14*b* formed within a housing 16. The housing 16 may be a rectangular aluminium extrusion of which the interior is divided into two elongate chambers by a central partition wall.

The diagram shows only the bottom stile sections 11*a* and 11*b* of the ladder and does not show any of the rungs. Such details of the construction of the telescopic ladder are not material to the present invention and the interested reader will find a fuller description in U.S. Pat. No. 5,495,915. The diagram also does not show the manner in which the housing 16 is secured to the foot of the ladder, which can be achieved either by mechanical fixings or by welding.

Figure 2:
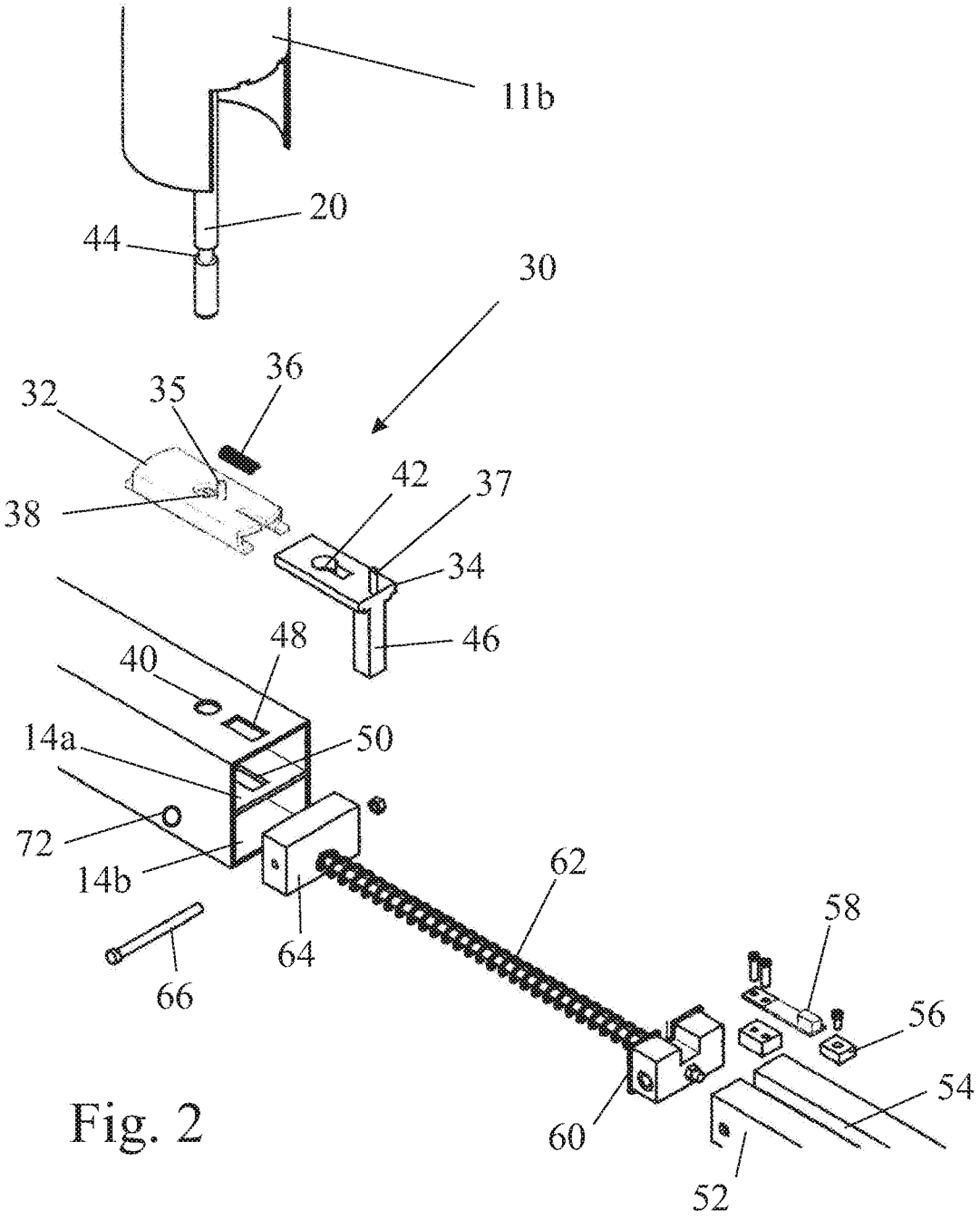
FIG. 2 is a detail of FIG. 1 drawn to an enlarged scale in the interest of clarity.

The present invention is concerned with improving the safety of a collapsible ladder fitted with retractable stabiliser bars by ensuring that it can only be extended and used when the stabiliser bars are correctly deployed. The manner in which this is achieved will now be described with reference to the drawings. The drawing, in all but minor details which will be mentioned below, is mirror symmetrical about the vertical centreline of the ladder and therefore only the components of the right hand side of the ladder, as shown to an enlarged scale in FIG. 2, will now be described.

On each side of the ladder, an inextensible member in the form rod 20 is secured either to the rung or to the stile of the uppermost stile section. The length of the rod is such that it reaches down as far as the housing when the ladder is fully collapsed. In the case of the right stile, shown in FIG. 2, it reaches as far down as the partition wall between the chambers 14*a* and 14*b*. i.e. as far down as the upper wall of the lower chamber 14*b* whereas on the left hand side it only reaches as far down as the upper wall of the upper chamber 14*a*. When the ladder is extended, the rod extends a short distance into the next to uppermost stile section and it is secured to the uppermost stile section in such a manner that it is held concentric with the ladder sections. If all the stile sections are fitted with dampers at their lower ends, it is necessary to ensure that the dampers have holes to allow the rod 20 to reach the housing 16 of the stabiliser bars 12*a* and 12*b*. If necessary, guide plates with conically tapering holes may be provided to ensure that the rod 20 lies concentrically within the stile, this being important to ensure correct alignment of the rod with the catch mechanism.

The catch mechanism, generally designated 30, comprises a stationary guide plate 32 suitably secured to the housing 16 in a manner shown, a slidable catch plate 34 and a tension spring 36 acting between two upwardly projecting pegs 35 and 37 on the guide plate 32 and the catch plate 34, respectively. The catch plate 34 is captive within the guide plate 32 and is slidable in a direction parallel to the length of the housing 16.

The guide plate 32 has a hole 38 that overlies a hole 40 in the upper wall of the housing and a similar hole (not shown) in the partition wall between the two chambers 14*a* and 14*b*. The hole in the partition wall is not required on the other side of the ladder. A keyhole shaped slot 42 is formed in the catch plate 34. The large round end of the keyhole slot 42 is as large as the cross section of the rod 20. The narrow end of the keyhole slot 42 is narrower than the rod 20 but can engage a notch 44 formed by a necked portion of the rod 20.

The catch plate 34 also has a downward projection 46 that extends through holes 48 and 50 into the lower chamber 14*b* of the housing. This projection 46 contacts an abutment 56 on the stabiliser bar 12*b* when it is deployed to move the catch plate 34 to the right, as viewed in FIG. 2. On the other side of the ladder, the downward projection 46 is shorter and there are no holes in the partition wall of the housing as the shorter rod 20 and the shorter projection 46 interact with the stabiliser bar 12*a* located in the upper chamber 14*a*.

The stabiliser bar 12*b* has a foot 51 that rests on the ground when it is deployed and an arm 52 that is snugly received in the chamber 14*b*. The top of the arm 52 has a longitudinally extending groove 54 that accommodates the end of the projection 46 of the catch plate 34. At the end of the arm 52 there is mounted an abutment 56 and a resiliently biased detent 58 which serves to lock the arm 52 in a deployed position.

Within each of the chambers 14*a* and 14*b* there is mounted a piston 60 biased by a spring 62 to urge the respective stabiliser bar 12*a* of 12*b* into its deployed position. The piston 60 is slidable along a rod that extends from an anchoring block 64 secured to the housing 16, at the end opposite the end from which the stabiliser bar projects, by means of a bolt 66. The arm 52 is hollow and when the stabiliser bar is retracted into the chamber, the rod connected to the anchoring block 64 is received within the arm 52.

In the collapsed state of the telescopic ladder, when the stabiliser bars are retracted, the rod 20 passes through the hole 38 in the guide plate 32, through hole 40 and through the upper chamber 14*a* to engage in and occupy the hole (obscured/not shown) in the partition wall between the two chambers 14*a* and 14*b* but does not penetrate into the chamber 14*b*. The spring 36 urges the catch plate 34 to the left as viewed in FIG. 2 and, as a result, the necked portion 44 of the rod 20 is retained within the narrower end of the keyhole slot 42 and this prevents the rod 20 from moving upwards and the ladder from being extended.

In order to extend the ladder, it is essential first to deploy the stabiliser bars 12*a* and 12*b*. Each stabiliser bar is retained in the retracted position by spring biased detents 70 that engage in holes 72 in the housing 16. The detent 70 is released by depressing manually to disengage it from the hole 72 in the housing. Once released, the spring 62 and the piston 60 push the stabiliser bar 12*b* out of the chamber 14*b* and the projection 46 slides along the groove 54 until it engages the abutment 56. At this point, continued movement of the arm 52 will also displace the projection 46 to the right until it reaches the end of the elongate slot 48.

In this position of the catch plate 34, the rod 20 is aligned with the larger end of the keyhole slot 42 and is therefore no longer held captive by the catch mechanism 30. The ladder can therefore now be extended and collapsed as required.

As soon as the ladder is extended, the rod 20 vacates the hole in the partition wall of the housing (or in the outer wall of the housing in the case of the other stabiliser bar) allowing the resilient detent 58 to engage in the same hole. This engagement now prevents the stabiliser bar from being retracted into the housing until the detent is released by collapsing the ladder.

Before each stabiliser bar can be retracted, it is necessary first to collapse all the rungs against one other to allow the rod 20 to reach down and release the detent 58. Once the detent 58 has been released, the stabiliser bar can be retracted and as it moves to the left, as viewed in FIG. 2, it releases the projection 46 of the catch plate 34. The spring 36 then moves the catch plate to the left, as viewed in FIG. 2, to trap the necked portion of the rod 20 within the narrow end of the slot 42 and thereby prevent the ladder from being extended until the stabiliser bar is once again deployed.

It will be appreciated that the above description has been given only by way of example and many modifications may be made without departing from the scope of the invention as set out in the appended claims. For example, the design of the catch mechanism may differ considerably and may, for example, employ a pivoted pawl in place of a slidable catch plate. Furthermore, the stabiliser bars may rotate between storage and deployed position instead of being retractable into a housing.

The invention claimed is:

1. A collapsible ladder comprising:

two telescopically collapsible stiles, a plurality of rungs secured to respective sections of the two telescopically collapsible stiles, a foot defined by a lowermost sections of the two stiles, and one or more stabiliser bars secured to the foot of the ladder, each of the one or more stabiliser bars being displaceable between a storage position in which the stabiliser bar lies, at least predominantly, between the two stiles and a deployed position in which the stabiliser bar widens the footprint of the ladder to improve the lateral stability of the ladder, wherein a spring biased catch mechanism is provided at the foot of the ladder to engage an inextensible member connected to at least one uppermost stile section when the ladder is collapsed, the catch mechanism being releasable by an associated stabiliser bar of the one or more stabiliser bars to permit the ladder to be extended only when the stabiliser bar is in the deployed position.

2. A collapsible ladder as claimed in claim 1, wherein the inextensible member is a rod connected to extend downwardly from the uppermost stile section of the ladder.

3. A collapsible ladder as claimed in claim 2, wherein the one or more stabiliser bars comprise two stabiliser bars each retractable against a force of a respective spring into a respective one of two elongate chambers arranged within a housing that is secured to the foot of the ladder, the two chambers being disposed in a same plane as the rungs of the ladder, each of the two stabiliser bars being associated with a respective one of said catch mechanism engageable with a respective one of said rod connected to a respective one of two said uppermost stile sections.

4. A collapsible ladder as claimed in claim 3, wherein each catch mechanism comprises a catch plate movably supported relative to the housing and urged by a spring into engagement with a notch in the end of the rod when the ladder is collapsed in order to prevent the ladder from being extended.

5. A collapsible ladder as claimed in claim 4, wherein each catch plate is mounted for sliding movement relative to respective housing in a direction parallel to the axes of the chambers.

6. A collapsible ladder as claimed in claim 5, wherein in each catch mechanism the notch extends around the periphery of the rod and is defined by a necked portion of the rod, and wherein the catch plate is formed with a keyhole slot having an enlarged end capable of receiving the end of the rod and a narrower end capable of engaging the notch.

7. A collapsible ladder as claimed in claim 5, wherein each catch plate has a projection extending through one or more holes in the housing into a respective one of the two chambers to engage an abutment movable with a respective one of the stabiliser bars in order to displace the catch plate against the action of the associated spring into a position where the rod is released when the stabiliser bar is deployed.

8. A collapsible ladder as claimed in claim 1, wherein the catch mechanism comprises a resiliently biased detent to prevent movement of the associated stabiliser bar away from the deployed position, and wherein the detent is movable by the inextensible member connected to the uppermost stile section of the ladder to allow the stabiliser bar to be retracted only when the ladder is fully telescopically collapsed.

9. A collapsible ladder as claimed in claim 8, wherein the resiliently biased detent is mounted for movement with the stabiliser bar and is engageable in a hole in the housing when the stabiliser bar is deployed to prevent retraction of the stabiliser bar, and wherein the latter hole is aligned with the inextensible member and is occupied by the inextensible member when the ladder is collapsed.

10. A collapsible ladder as claimed in claim 6, wherein each catch plate has a projection extending through one or more holes in the housing into a respective one of the two chambers to engage an abutment movable with a respective one of the stabiliser bars in order to displace the catch plate against the action of the associated spring into a position where the rod is released when the stabiliser bar is deployed.

11. A collapsible ladder as claimed in claim 3, wherein each catch mechanism comprises a resiliently biased detent to prevent movement of the associated stabiliser bar away from the deployed position, and wherein the detent is movable by the inextensible member connected to the uppermost stile section of the ladder to allow the stabiliser bar to be retracted only when the ladder is fully telescopically collapsed.

* * * * *